US009932729B1

(12) United States Patent
Yeh

(10) Patent No.: US 9,932,729 B1
(45) Date of Patent: Apr. 3, 2018

(54) CONTROL HANDLE MODULE AVAILABLE FOR TOILETS OF DIFFERENT SPECIFICATIONS

(71) Applicant: Alexander Yeh Industry Co., Ltd., Changhua Hsien (TW)

(72) Inventor: Cheng-Yen Yeh, Changhua Hsien (TW)

(73) Assignee: Alexander Yeh Industry Co., Ltd., Changhua Hsien (TW)

( * ) Notice: Subject to any disclaimer, the term of this patent is extended or adjusted under 35 U.S.C. 154(b) by 0 days.

(21) Appl. No.: 15/422,582

(22) Filed: Feb. 2, 2017

(51) Int. Cl.
*E03D 5/092* (2006.01)
*F16K 31/60* (2006.01)

(52) U.S. Cl.
CPC ..... *E03D 5/092* (2013.01); *F16K 31/602* (2013.01)

(58) Field of Classification Search
CPC ..... E03D 5/092; F16K 31/602
USPC ..... 4/405, 413, 414
See application file for complete search history.

(56) References Cited

U.S. PATENT DOCUMENTS 7,861,330 B2 * 1/2011 Tau ..... E03D 5/092 4/405
9,469,980 B2 * 10/2016 Le ..... E03D 5/092 4/413
2005/0273919 A1 * 12/2005 Berlovan ..... E03D 5/092 4/405

* cited by examiner

*Primary Examiner* — Tuan N Nguyen
(74) *Attorney, Agent, or Firm* — Alan D. Kamrath; Kamrath IP Lawfirm, P.A.

(57) ABSTRACT

A control handle module includes a flush handle, a first lever and a second lever. The flush handle has an extension. The first lever is secured on the extension. The first lever includes a body section, a fixing portion and a pivot base. The pivot base has an arcuate periphery which is provided with a first stop rib and a second stop rib. The second lever has a first shank and a second shank. The second shank has a resting face and a pivot ear. The pivot ear is pivotally connected with the pivot base. The resting face rests on the first stop rib or the second stop rib.

7 Claims, 9 Drawing Sheets

CONTROL HANDLE MODULE AVAILABLE FOR TOILETS OF DIFFERENT SPECIFICATIONS

BACKGROUND OF THE INVENTION

1. Field of the Invention

The present invention relates to a handle module and, more particularly, to a control handle module for a toilet tank.

2. Description of the Related Art

A control handle module is mounted on a toilet tank to control the water flush function. The toilet tank is provided with a mounting hole for mounting the control handle module. In general, the mounting hole is located at a front part, a corner or a side of the toilet tank. Thus, three types of control handle modules are needed to fit the mounting hole of the toilet tank of three different specifications. However, the three types of control handle modules have different mounting manners and cannot be assembled universally, so that the consumer has to actually select the required control handle module to fit the mounting hole of the toilet tank, thereby causing inconvenience to the consumer in purchase and assembly of the control handle module.

BRIEF SUMMARY OF THE INVENTION

The primary objective of the present invention is to provide a universal control handle module available for toilet tanks of different specifications.

In accordance with the present invention, there is provided a control handle module comprising a flush handle, a first lever and a second lever. The flush handle is a member for controlling water flush of a toilet tank. The flush handle has a side face provided with an extension protruding outward. A fixing block is mounted on the extension of the flush handle to allow a determined rotation of the flush handle when the flush handle is pressed during the water flush of the toilet tank. The fixing block has a periphery provided with a threaded section, and a fixing nut is screwed onto the threaded section of the fixing block. The first lever is secured on the extension of the flush handle. The first lever includes a body section, a fixing portion located at a first side of the body section and a pivot base located at a second side of the body section. The fixing portion of the first lever is secured to the extension of the flush handle. The first lever is locked by the extension of the flush handle, so that the first lever and the flush handle are rotated simultaneously during the water flush of the toilet tank. The pivot base of the first lever protrudes from the second side of the body section and has an arcuate periphery. The arcuate periphery of the pivot base is provided with a first stop rib and a second stop rib each extending longitudinally. The first stop rib and the second stop rib of the pivot base are spaced with a determined angle. The first stop rib of the pivot base is arranged at a mediate position of the arcuate periphery, and the second stop rib of the pivot base is arranged at a position opposite to the body section. The second lever is made of metal material and is bent to integrally form a first shank and a second shank. The second shank of the second lever has an outside provided with a resting face and has an upper edge provided with a pivot ear protruding from the resting face. The pivot ear of the second lever is pivotally connected with the pivot base of the first lever and abuts a top face of the pivot base. The resting face of the second lever is driven by the second lever and rests on the first stop rib or the second stop rib of the first lever, so that the second lever has operation angles that are changed corresponding to different mounting positions of the flush handle on the toilet tank.

According to the primary advantage of the present invention, the second lever has different bending angles so that the control handle module is available for the toilet tank of different specifications, thereby greatly enhancing the versatility of the control handle module.

According to another advantage of the present invention, the consumer can directly buy and use the control handle module, without having to select, compare and match the control handle module with the specification of the toilet tank, thereby facilitating the consumer purchasing and mounting the control handle module.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
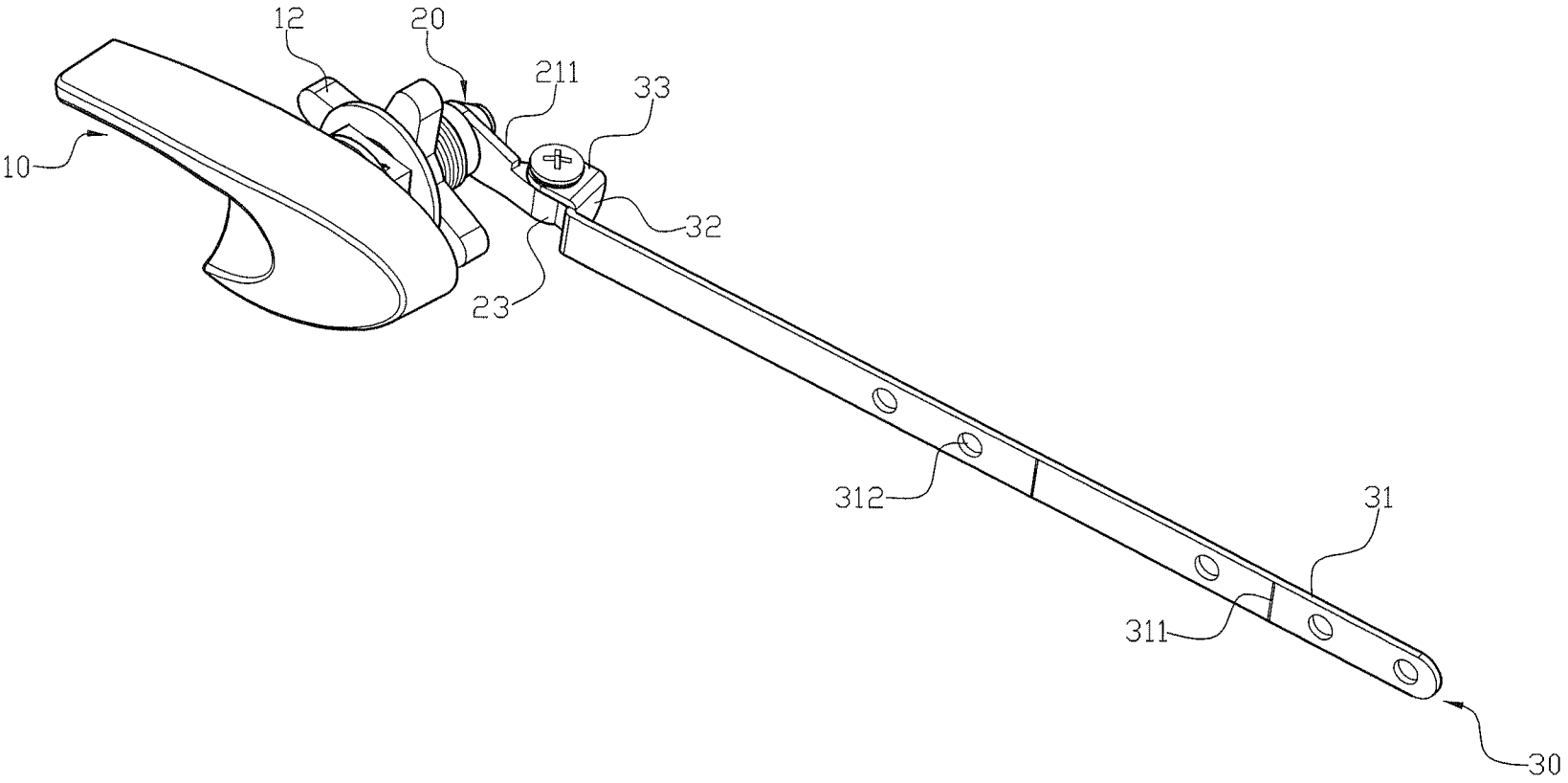
FIG. 1 is a perspective view of a control handle module in accordance with the preferred embodiment of the present invention.
Figure 2:
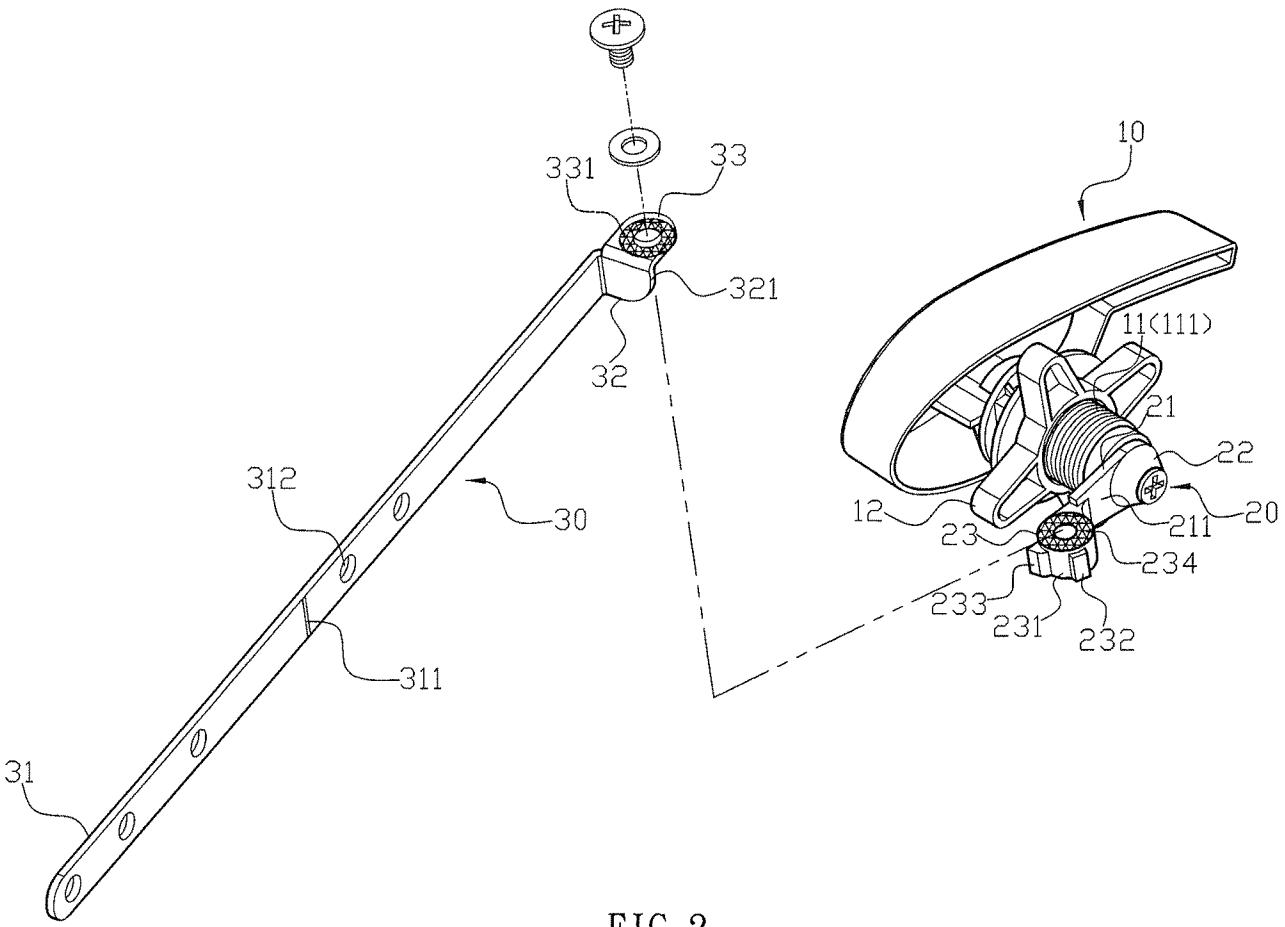
FIG. 2 is an exploded perspective view of the control handle module in accordance with the preferred embodiment of the present invention.
Figure 3:
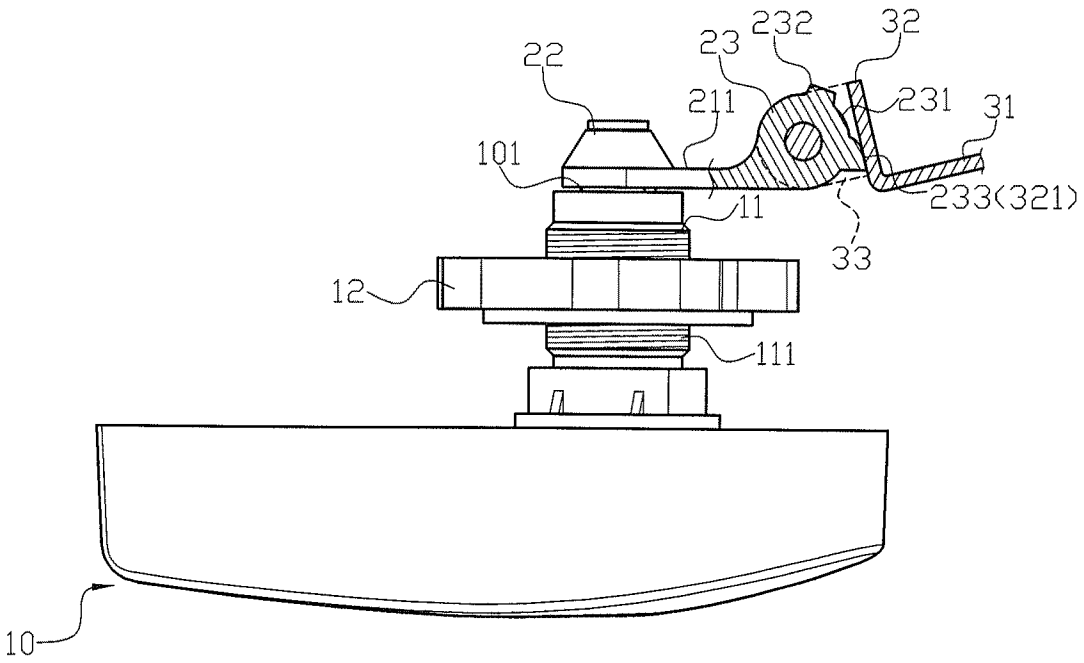
FIG. 3 is a partially cross-sectional assembly view of the control handle module in accordance with the preferred embodiment of the present invention.

Referring to the drawings and initially to FIGS. 1-3, a control handle module in accordance with the preferred embodiment of the present invention comprises a flush handle 10, a first lever 20 and a second lever 30.

The flush handle 10 is a member for controlling water flush of a toilet tank. The flush handle 10 has a side face provided with an extension 101 protruding outward. A fixing block 11 is mounted on the extension 101 of the flush handle 10 to allow a determined rotation of the flush handle 10 when the flush handle 10 is pressed during the water flush of the toilet tank. The fixing block 11 has a periphery provided with a threaded section 111, and a fixing nut 12 is screwed onto the threaded section 111 of the fixing block 11.

The first lever 20 is secured on the extension 101 of the flush handle 10. The first lever 20 includes a body section 21, a fixing portion 22 located at a first side of the body section 21 and a pivot base 23 located at a second side 211 of the body section 21. The fixing portion 22 of the first lever 20 is secured to the extension 101 of the flush handle 10. The first lever 20 is locked by the extension 101 of the flush handle 10, so that the first lever 20 and the flush handle 10 are rotated simultaneously during the water flush of the toilet tank. The pivot base 23 of the first lever 20 protrudes from the second side 211 of the body section 21 and has an arcuate periphery 231. The arcuate periphery 231 of the pivot base 23 is provided with a first stop rib 232 and a second stop rib 233 each extending longitudinally. The first stop rib 232 and the second stop rib 233 of the pivot base 23 are spaced with a determined angle. The first stop rib 232 of the pivot base 23 is arranged at a mediate position of the arcuate periphery 231, and the second stop rib 233 of the pivot base 23 is arranged at a position opposite to the body section 21.

The second lever 30 is made of metal material and is bent to integrally form a first shank 31 and a second shank 32. The second shank 32 of the second lever 30 has an outside provided with a resting face 321 and has an upper edge provided with a pivot ear 33 protruding from the resting face 321. The pivot ear 33 of the second lever 30 is pivotally connected with the pivot base 23 of the first lever 20 and abuts a top face of the pivot base 23. The resting face 321 of the second lever 30 is driven by the second lever 30 and rests on the first stop rib 232 or the second stop rib 233 of the first lever 20, so that the second lever 30 has operation angles that are changed corresponding to different mounting positions of the flush handle 10 on the toilet tank.

In the preferred embodiment of the present invention, the fixing portion 22 of the first lever 20 is a locking hole pillar.

In the preferred embodiment of the present invention, the pivot base 23 of the first lever 20 has a center provided with a pivot hole, and the pivot ear 33 of the second lever 30 has a center provided with a pivot hole aligning with and connected with the pivot hole of the pivot base 23 by a screw, so that the pivot ear 33 of the second lever 30 is pivotally connected with the pivot base 23 of the first lever 20.

In the preferred embodiment of the present invention, the pivot base 23 of the first lever 20 has a face provided with a knurl 234, and the pivot ear 33 of the second lever 30 has a face provided with a knurl 331 engaging the knurl 234 of the pivot base 23 to enhance a surface friction between the pivot base 23 of the first lever 20 and the pivot ear 33 of the second lever 30.

In the preferred embodiment of the present invention, the first shank 31 of the second lever 30 is provided with a plurality of marking lines 311 spaced from each other. In such a manner, if the first shank 31 of the second lever 30 is too long during assembly, the first shank 31 of the second lever 30 is cut by indication of the marking lines 311.

In the preferred embodiment of the present invention, the first shank 31 of the second lever 30 is provided with a plurality of hanging holes 312 for hanging a pull member of a water stop valve of the toilet tank. Preferably, the pull member is a lift chain.

When in use, the toilet tank is provided with a mounting hole for mounting the control handle module. After assembly of the control handle module is finished, the second lever 30 is driven to change the angle between the second lever 30 and the first lever 20, so as to correspond to different positions of the mounting hole of the toilet tank.

Figure 4:
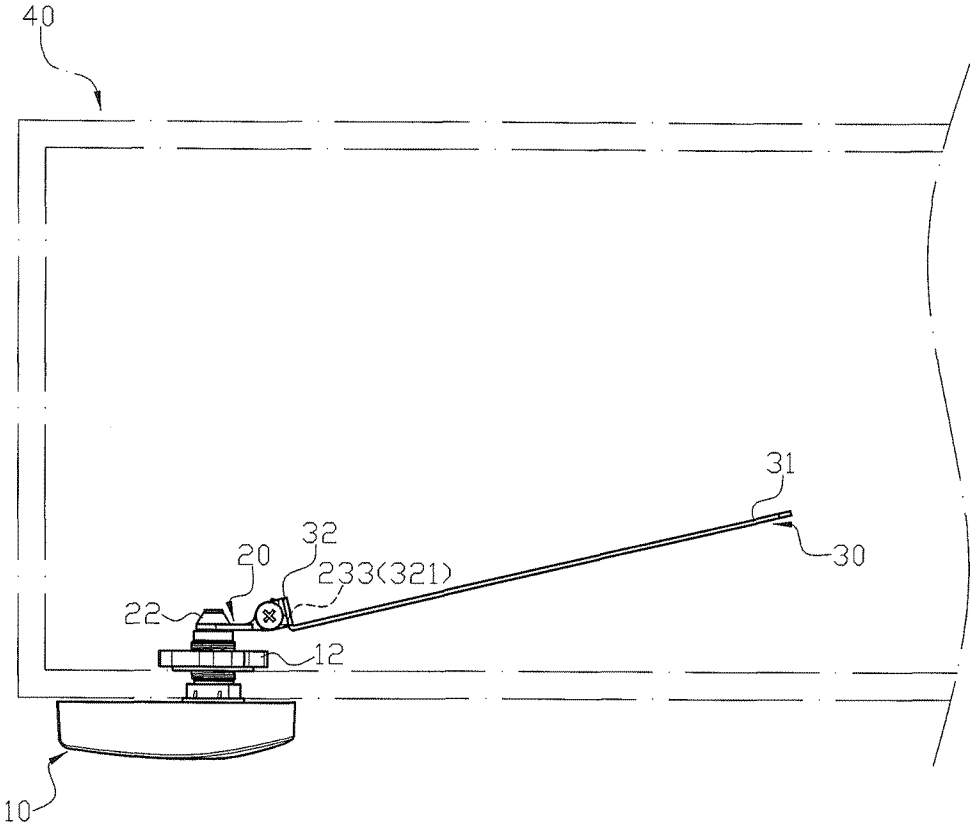
FIG. 4 is a schematic operational view of the control handle module which is mounted on the front part of a toilet tank.

In assembly, referring to FIG. 4 with reference to FIGS. 1-3, the mounting hole is located at the front part of the toilet tank 40. The fixing nut 12 is detached initially. Then, the second lever 30, the first lever 20 and the fixing block 11 in turn extend through the mounting hole into the inside of the toilet tank 40, with the flush handle 10 being located outside of the toilet tank 40. Then, the fixing nut 12 is screwed onto the threaded section 111 of the fixing block 11 and presses the wall of the toilet tank 40, so as to lock the control handle module onto the toilet tank 40. At this time, the resting face 321 of the second lever 30 rests on the second stop rib 233 of the first lever 20, so that the second lever 30 and the first lever 20 are almost kept at the same line as shown in FIG. 4. In such a manner, the second lever 30 is connected with the pull member of the water stop valve of the toilet tank 40 by extension of the first shank 31 of the second lever 30.

Figure 5:
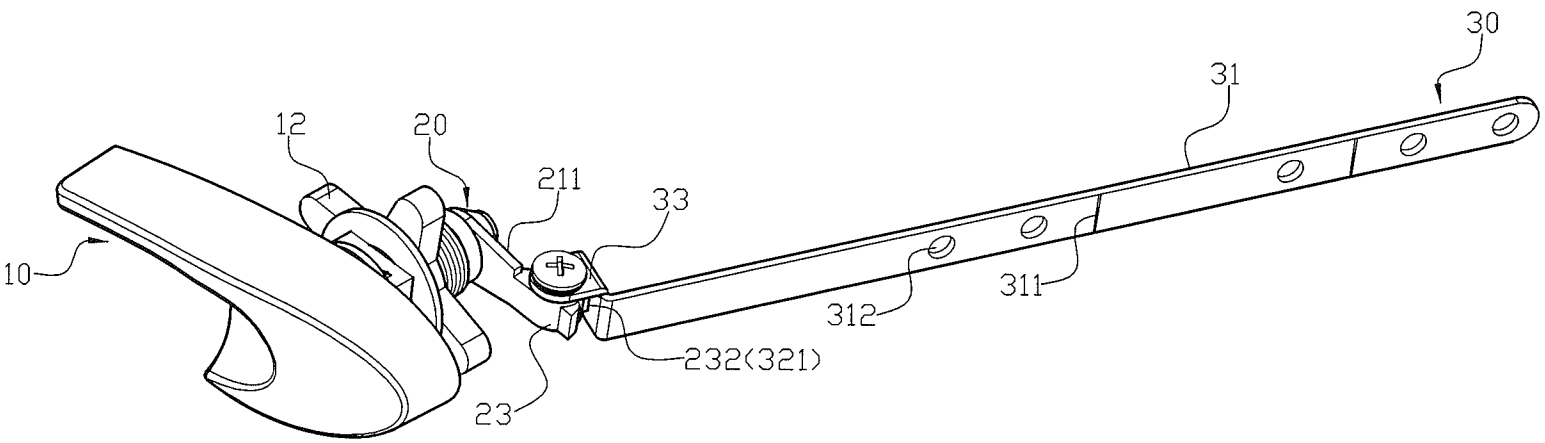
FIG. 5 is a schematic operational view of the control handle module as shown in FIG. 1, in adjustment of the angle between the first lever and the second lever.
Figure 6:
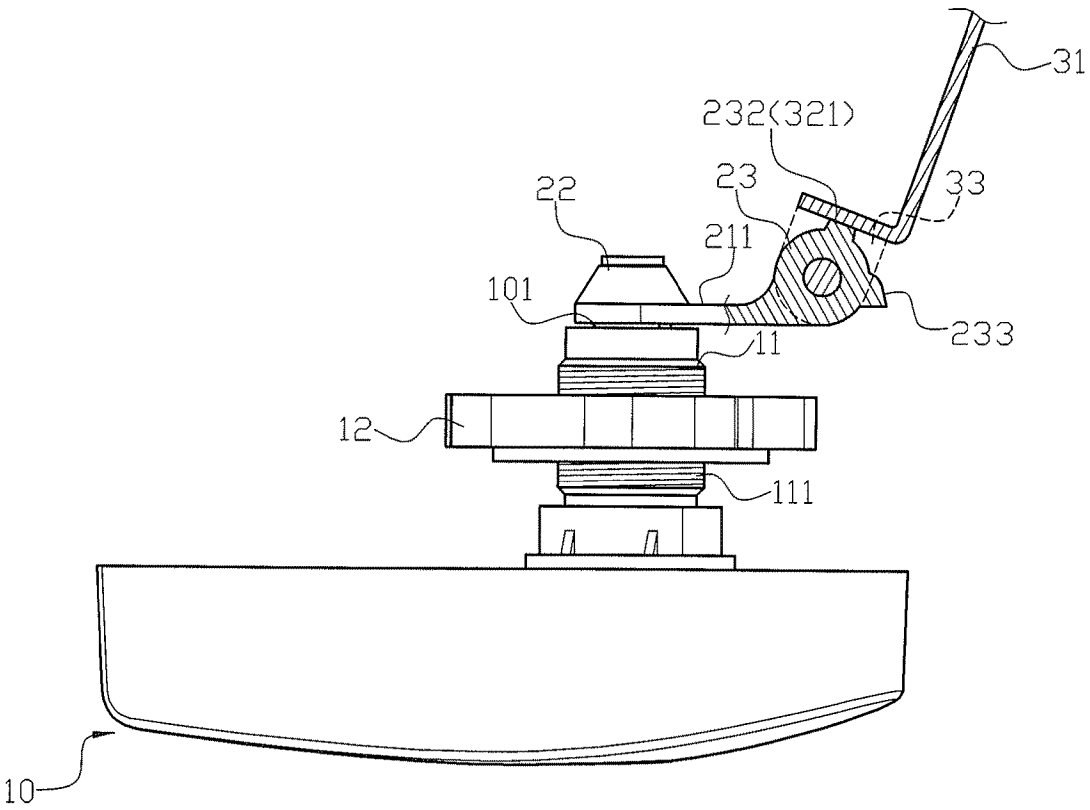
FIG. 6 is a schematic operational view of the control handle module as shown in FIG. 3, in adjustment of the angle between the first lever and the second lever.

Referring to FIGS. 5 and 6, when the second lever 30 is driven toward the first stop rib 232 of the first lever 20, the resting face 321 of the second lever 30 is moved to rest on the first stop rib 232 of the first lever 20, so as to change the angled position of the second lever 30. Thus, a larger angle is formed between the first lever 20 and the second lever 30.

Figure 7:
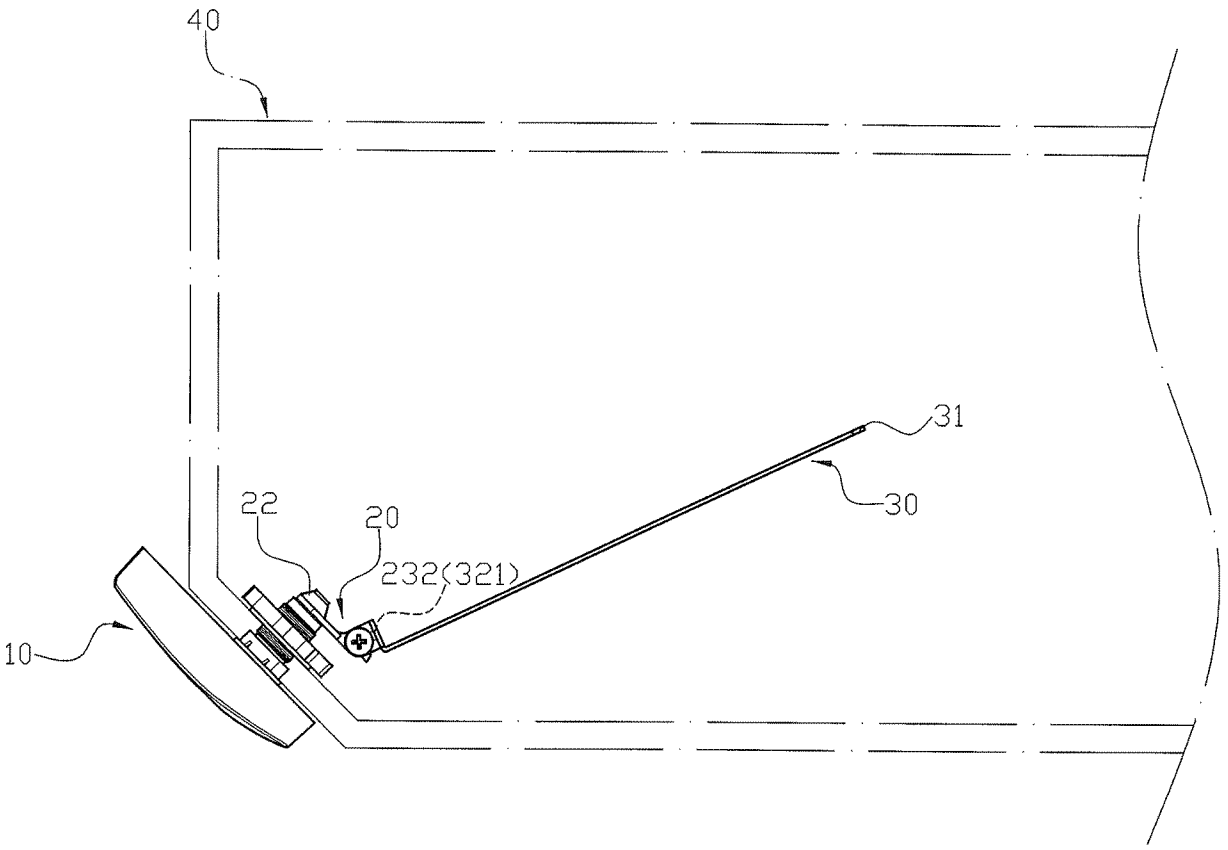
FIG. 7 is a schematic operational view of the control handle module which is mounted on the corner of the toilet tank.

Referring to FIG. 7, the mounting hole is located at a corner of the toilet tank 40, so that the control handle module is mounted on the corner of the toilet tank 40. At this time, the resting face 321 of the second lever 30 rests on the first stop rib 232 of the first lever 20, and a larger angle is formed between the first lever 20 and the second lever 30. In such a manner, the second lever 30 is connected with the pull member of the water stop valve of the toilet tank 40 by extension of the first shank 31 of the second lever 30.

Figure 8:
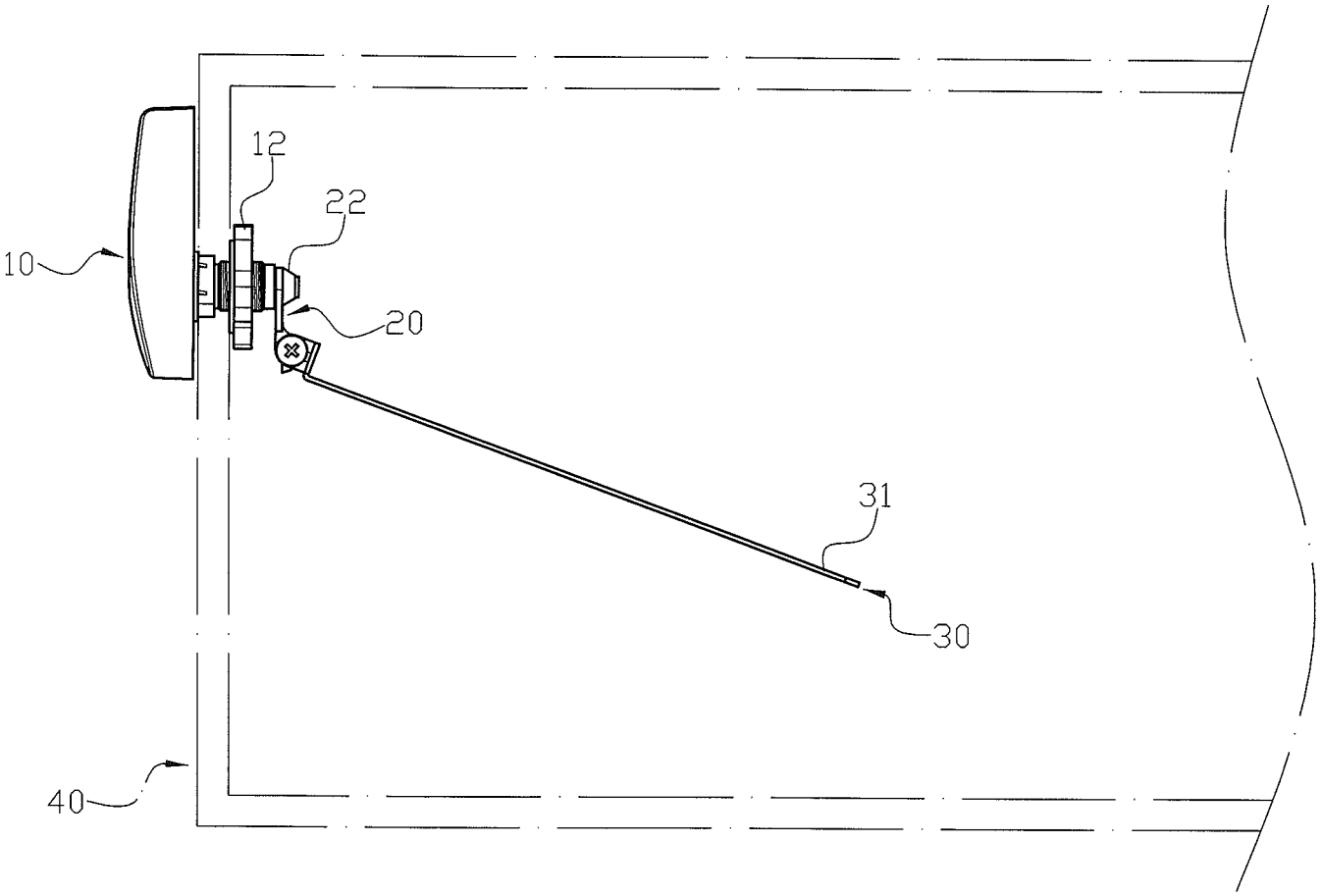
FIG. 8 is a schematic operational view of the control handle module which is mounted on the side of the toilet tank.

Referring to FIG. 8, the mounting hole is located at a side of the toilet tank 40, so that the control handle module is mounted on the side of the toilet tank 40. In such a manner, the second lever 30 is connected with the pull member of the water stop valve of the toilet tank 40 by extension of the first shank 31 of the second lever 30.

Figure 9:
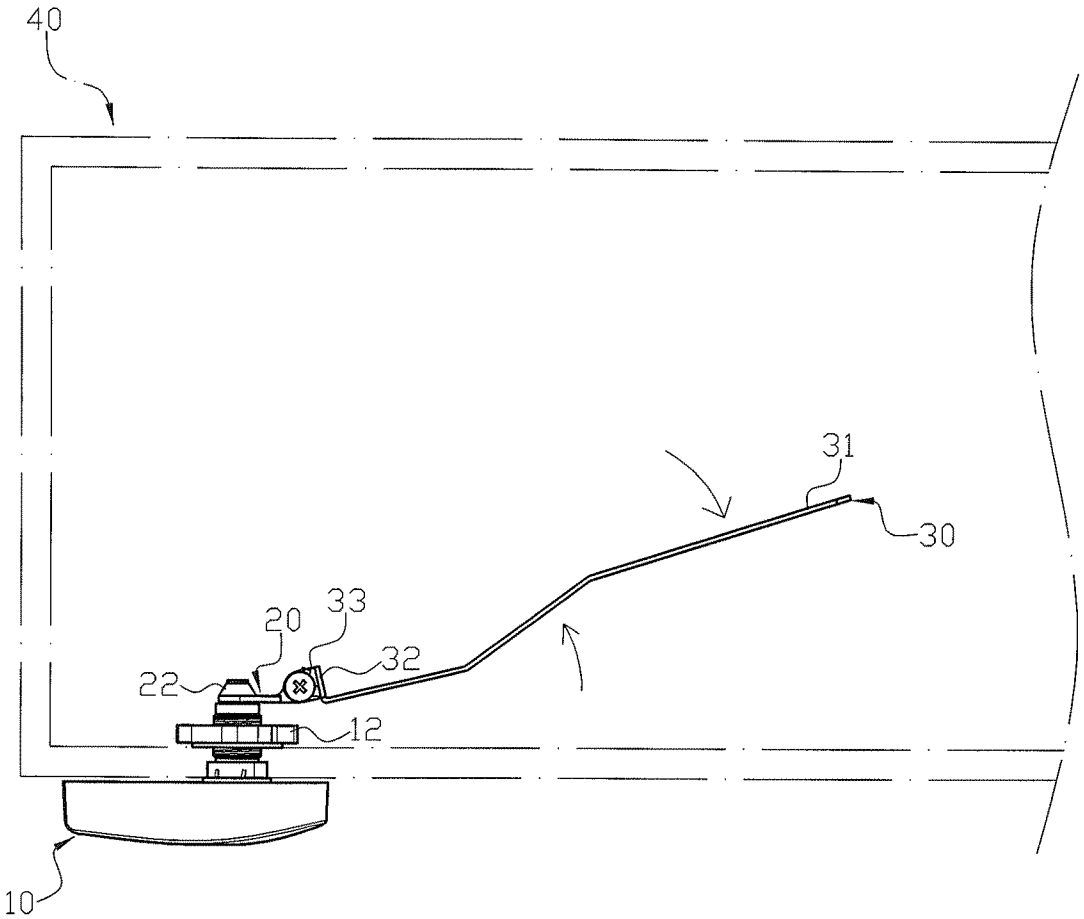
FIG. 9 is a schematic operational view of the control handle module as shown in FIG. 1, wherein the second lever is slightly bent by an external force.

Referring to FIG. 9, the second lever 30 is made of copper which has better ductility, so that the second lever 30 is slightly bent by an external force during the mounting process of the control handle module.

Accordingly, the second lever 30 has different bending angles so that the control handle module is available for the toilet tank 40 of different specifications, thereby greatly enhancing the versatility of the control handle module. In addition, the consumer can directly buy and use the control handle module, without having to select, compare and match the control handle module with the specification of the toilet tank 40, thereby facilitating the consumer purchasing and mounting the control handle module.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A control handle module comprising:

a flush handle, a first lever and a second lever;

wherein:

the flush handle is a member for controlling water flush of a toilet tank;

the flush handle has a side face provided with an extension protruding outward;

a fixing block is mounted on the extension of the flush handle to allow a determined rotation of the flush handle when the flush handle is pressed during the water flush of the toilet tank;

the fixing block has a periphery provided with a threaded section;

a fixing nut is screwed onto the threaded section of the fixing block;

the first lever is secured on the extension of the flush handle;

the first lever includes a body section, a fixing portion located at a first side of the body section and a pivot base located at a second side of the body section;

the fixing portion of the first lever is secured to the extension of the flush handle;

the first lever is locked by the extension of the flush handle, so that the first lever and the flush handle are rotated simultaneously during the water flush of the toilet tank;

the pivot base of the first lever protrudes from the second side of the body section and has an arcuate periphery;

the arcuate periphery of the pivot base is provided with a first stop rib and a second stop rib each extending longitudinally;

the first stop rib and the second stop rib of the pivot base are spaced with a determined angle;

the first stop rib of the pivot base is arranged at a mediate position of the arcuate periphery;

the second stop rib of the pivot base is arranged at a position opposite to the body section;

the second lever is made of metal material and is bent to integrally form a first shank and a second shank;

the second shank of the second lever has an outside provided with a resting face and has an upper edge provided with a pivot ear protruding from the resting face;

the pivot ear of the second lever is pivotally connected with the pivot base of the first lever and abuts a top face of the pivot base; and the resting face of the second lever is driven by the second lever and rests on the first stop rib or the second stop rib of the first lever, so that the second lever has operation angles that are changed corresponding to different mounting positions of the flush handle on the toilet tank.

2. The control handle module of claim 1, wherein the fixing portion of the first lever is a locking hole pillar.

3. The control handle module of claim 1, wherein the pivot base of the first lever has a center provided with a pivot hole, and the pivot ear of the second lever has a center provided with a pivot hole aligning with and connected with the pivot hole of the pivot base by a screw, so that the pivot ear of the second lever is pivotally connected with the pivot base of the first lever.

4. The control handle module of claim 1, wherein the pivot base of the first lever has a face provided with a knurl, and the pivot ear of the second lever has a face provided with a knurl engaging the knurl of the pivot base to enhance a surface friction between the pivot base of the first lever and the pivot ear of the second lever.

5. The control handle module of claim 1, wherein the first shank of the second lever is provided with a plurality of marking lines.

6. The control handle module of claim 1, wherein the first shank of the second lever is provided with a plurality of hanging holes.

7. The control handle module of claim 1, wherein the second lever is made of copper.

* * * * *